US006431436B1

(12) United States Patent
Evers

(10) Patent No.: US 6,431,436 B1
(45) Date of Patent: Aug. 13, 2002

(54) STACKABLE ARCHIVE CONTAINER

(76) Inventor: Wilhelmus Johannes Albertus Antonius Evers, 9th Fl S-Gravenduyn, Groningsestraat 167, 2587 PC, Den Haag (NL)

( * ) Notice: Subject to any disclaimer, the term of this patent is extended or adjusted under 35 U.S.C. 154(b) by 0 days.

(21) Appl. No.: 09/622,529

(22) PCT Filed: Feb. 18, 1999

(86) PCT No.: PCT/NL97/00087

§ 371 (c)(1),
(2), (4) Date: Sep. 20, 2000

(87) PCT Pub. No.: WO99/42374

PCT Pub. Date: Aug. 26, 1999

(30) Foreign Application Priority Data

Feb. 19, 1998 (NL) ..... 1008359

(51) Int. Cl.[7] ..... B65D 21/024

(52) U.S. Cl. ..... 229/120.01; 206/504; 206/821; 220/23.4; 229/915; 493/84

(58) Field of Search ..... 229/120.01, 915; 220/23.4, 23.6; 493/84, 114, 115; 312/108, 111; 206/503, 504, 509, 821; 414/802

(56) References Cited

U.S. PATENT DOCUMENTS

| | | | | | |
|---|---|---|---|---|---|
| 986,395 | A | * | 3/1911 | King | 229/120.01 |
| 2,024,075 | A | | 12/1935 | Swaim | |
| 2,737,334 | A | * | 3/1956 | Halgren | 229/120.01 |
| 2,790,691 | A | * | 4/1957 | Goebel | 220/23.4 |
| 3,389,830 | A | * | 6/1968 | Smith | 220/23.4 |
| 3,552,579 | A | * | 1/1971 | Simon et al. | 229/915 |
| 3,989,157 | A | | 11/1976 | Veenema | |
| 4,210,274 | A | | 7/1980 | Leonard | |
| 4,239,306 | A | * | 12/1980 | Klaus | 312/111 |
| 4,436,243 | A | * | 3/1984 | Nason et al. | 229/915 |
| 4,969,568 | A | * | 11/1990 | Yoshida | 220/23.4 |
| 5,029,710 | A | * | 7/1991 | Workman et al. | 206/503 |
| 5,181,297 | A | * | 1/1993 | Andrews, Jr. et al. | 220/23.4 |
| 5,305,883 | A | * | 4/1994 | Gage et al. | 229/915 |
| 5,441,151 | A | * | 8/1995 | Billingham | 220/23.4 |

FOREIGN PATENT DOCUMENTS

| | | |
|---|---|---|
| BE | 523 542 A | 1/1956 |
| FR | 696 814 A | 1/1931 |
| GB | 1072371 A | 6/1967 |

* cited by examiner

*Primary Examiner*—Gary E. Elkins
(74) *Attorney, Agent, or Firm*—Alston & Bird LLP

(57) ABSTRACT

A stackable archive container (10) is formed from a cardboard sheet, and comprises, when in the stacked state, two side walls (14, 16), a top wall (18), a bottom wall (20) and a rear wall (12), with a closure flap (22) being hinged to the top or bottom wall. Reinforcing bars (41; 58; 64) are provided on the vertical side edges of the side walls and/or the back wall. The bars are typically extruded from aluminum, and have a U-shaped profile that extends the length of the side edges of the side and/or back walls, and embraces the side edges in a snug push fit. The reinforcing bars may have a U-, H- and/or W-configuration. The profiles enable the stacking height of the containers to be increased, and also serve to interconnect adjacent containers.

15 Claims, 3 Drawing Sheets

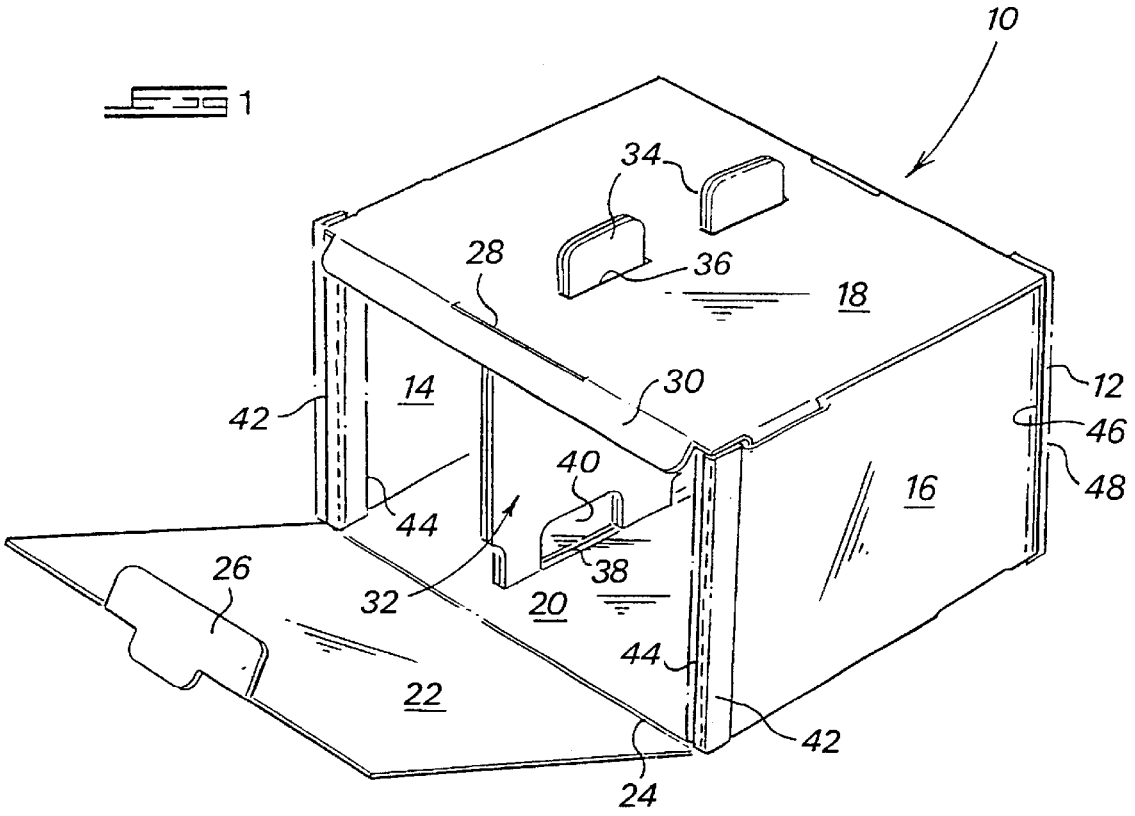
1
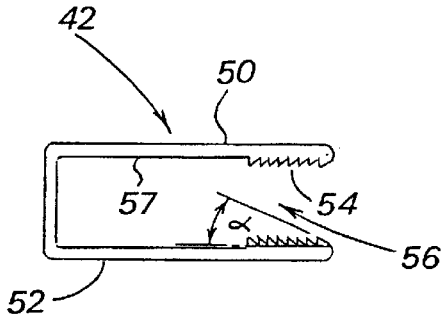
2A
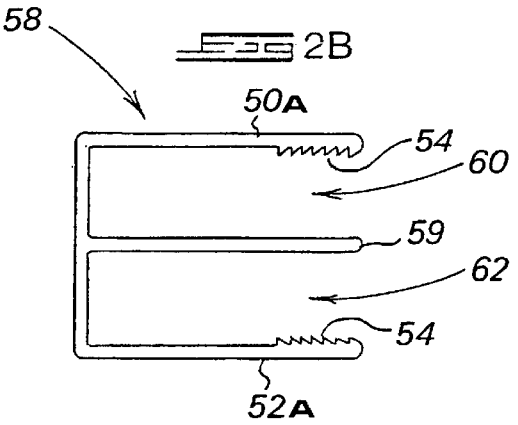
2B
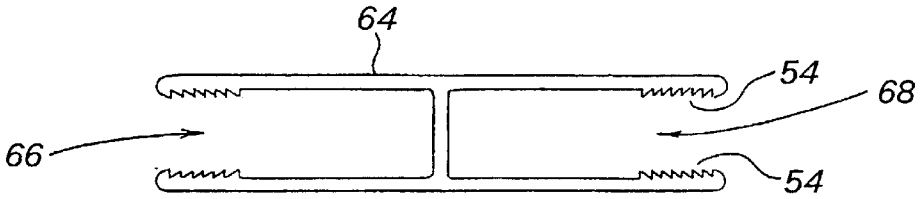
2C 10
64
12
34
36
28
36
34
18
30
58
42
40
14
38
26
32
20
16
22
58

58
42
10D
58
10E
10F
64
8
7
64
42
9
6
42
10A
58
10B
58
10C

STACKABLE ARCHIVE CONTAINER

BACKGROUND TO THE INVENTION

The invention relates to a stackable archive container made from a cardboard sheet, principally comprising a back wall and, when viewed in the stacked state, two side walls, a top wall and a bottom wall, wherein a pivoting closing flap is connected to one of the top or bottom walls.

Such archive containers are used on a large scale for storing archive boxes, files, dossiers and the like. In such an archive container four or six archive boxes can, for example, be stored, depending on the size of the boxes. Such archive containers can easily be moved and are self-stacking, and can also be placed back to back in an area. Accordingly, no vertical wall is necessary for the fastening of shelf supports to carry shelves or the like.

To support the top wall and to place the archive containers in the correct position relative to one another during the stacking operation, in certain cases the top wall and bottom wall are provided with a few slots which run parallel to the side walls and are positioned therebetween. The slots in the top wall serve to accommodate the projecting tongues of an intermediate dividing wall which on the underside is provided with recesses into which the tongues of an intermediate subjacent wall can be accommodated. This intermediate wall is a double wall and is made from the same cardboard sheet as the rest of the archive container.

A drawback of the known archive containers is that only a limited number of containers can be stacked on top of one another, due to the fact that their vertical walls can absorb only a certain load. This is particularly prevalent when the containers are stored in a damp area, where the damp cardboard loses its structural rigidity, and consequently tends to give way more quickly under a load.

U.S. Pat. No. 2,024,075 shows the possibility of reinforcing the edges of separate panels of a container by pushing profiles onto them. Here, however, such formed profiles are adapted and the walls of the container made in such a way that crenellated parts of the profiles provided along the four edges of a side wall fit into complementally crenellated parts of the profiles provided on the bottom wall, the rear wall, the top wall and the front wall. A rod is then pushed through two profiles that fit into one another so as to connect each edge of a side wall with the edges of the other walls. The side walls, therefore, do not form an integral whole with the other walls so that the resultant container is not made from one single sheet. Furthermore, the fitting of the profiles onto the various edges and the connecting together of the separate walls of a single container is time consuming and labour intensive. Provision is also not made for the joining together of adjacent containers.

From U.S. Pat. No. 3,989,157 and GB 1,0732,371 it is also known to reinforce the edges of panels by pushing profiles onto them. Here, however, the profiles are also used at the same time for joining the individual panels to one another, with the panels similarly not forming part of a unitary folded sheet.

SUMMARY OF THE INVENTION

According to a first aspect of the invention there is provided a stackable archive container folded from a cardboard blank of a predetermined thickness and comprising, in the folded state, a pair of side walls, a top wall, a bottom wall and a rear wall, and preferably a front closure flap hinged to the top or bottom walls, characterized in that rigid reinforcing bars are fitted to vertical side edges of the side walls and/or the rear wall at the comers of the container, the reinforcing bars extending the length of the side edges and each of the bars having at least one U-shaped profile for embracing the side edges in a snug push fit.

It will be clear that the reinforcing profiles are positioned between the top and bottom walls, in which case a few layers of cardboard will be sandwiched between the ends of the reinforcing profiles of two archive containers positioned above one another. However, in practice this does not present problems, with the cushioning effect provided by the cardboard enhancing the sturdiness of the stacked structure.

In a preferred form of the invention, the one or more U-shaped profiles of the reinforcing bars are configured to reinforce and to join together the vertical side edges of adjacent containers.

Preferably, at least one, and more preferably both of the opposed inner surfaces of the legs of the U-shaped profile are formed with wall-gripping ribs extending in the longitudinal direction of the bar for penetrating into the outer surfaces of the cardboard to provide a strong connection between the rib and the cardboard. These ribs will then penetrate slightly into the surface of the cardboard, so that the connection is enhanced between the reinforcing profile and the cardboard.

Advantageously, the ribs have a sawtooth profile arranged so that the surface of each rib directed towards the opening of the U-shaped profile defines a shallow angle relative to the leg of the U from which the ribs extend. As a result thereof the reinforcing profile can be pushed relatively easily onto a wall of the archive container, but the saw-tooth ribs will prevent the profile from slipping or sliding off the wall.

In one form of the invention, the reinforcing bars include reinforcing bars having a single U-shaped profile sized to accommodate a double wall thickness of cardboard in a snug push fit, the double wall thickness arising from either double wall thickness side walls or from adjacent single wall thickness side or rear walls of containers joined side-by-side or back-to-back.

The reinforcing bars may further include reinforcing bars having a double U-shaped profile in a side-by-side W configuration, for allowing side walls of adjacent containers to be connected together, whilst simultaneously being reinforced.

Advantageously, the side walls of the container have a double wall thickness, and each of the U-shaped profiles are sized to accommodate the side edges of the adjacent side walls in a snug push fit.

The reinforcing bars may still further include bars having a double U-shaped profile in a back-to-back H-configuration for allowing four containers to be connected together at their rear walls, whilst simultaneously being reinforced.

Typically, each of the rear walls have a single wall thickness, and each of the U-shaped profiles are arranged to accommodate the rear walls of a pair of containers in a back-to-back configuration.

The containers may be formed with complementary aligning formations for allowing them to be aligned when stacked on top of one another such that the reinforcing bars in the aligned stack define rigid co-linear reinforcing arrays allowing the overall height of the stack to be increased.

The reinforcing bars are preferably made of aluminium, which may be extrusion moulded.

The invention extends to a method of forming a stackable archive container comprising the steps of folding the container from a cardboard blank to provide a pair of side walls, a top wall, a bottom and a rear wall, and fitting rigid reinforcing bars to vertical side edges of the side walls and/or the rear wall at the corners of the container, the reinforcing bars extending the length of the side edges and each of the bars having at least one U-shaped profile for embracing the side edges in a snug push fit.

In a preferred form of the invention, the method includes the further step of joining together adjacent containers along their vertical side edges using the one or more U-shaped profiles of the reinforcing bars to embrace exposed adjacent side edges of adjacent containers in a snug push fit.

Conveniently, the method further includes the steps of stacking the containers on top of one another in an aligned configuration such that the reinforcing bars in the aligned stack define rigid co-linear reinforcing arrays allowing the overall height of the stack to be increased.

BRIEF DESCRIPTION OF THE DRAWINGS

FIG. 1 shows a perspective view of an archive container of the invention onto which reinforcing bars or profiles, indicated in broken outline, have been fitted;

FIGS. 2A to 2C show end-on views of first, second and third embodiments of reinforcing bars according to the invention;

DESCRIPTION OF EMBODIMENTS

Figure 3:
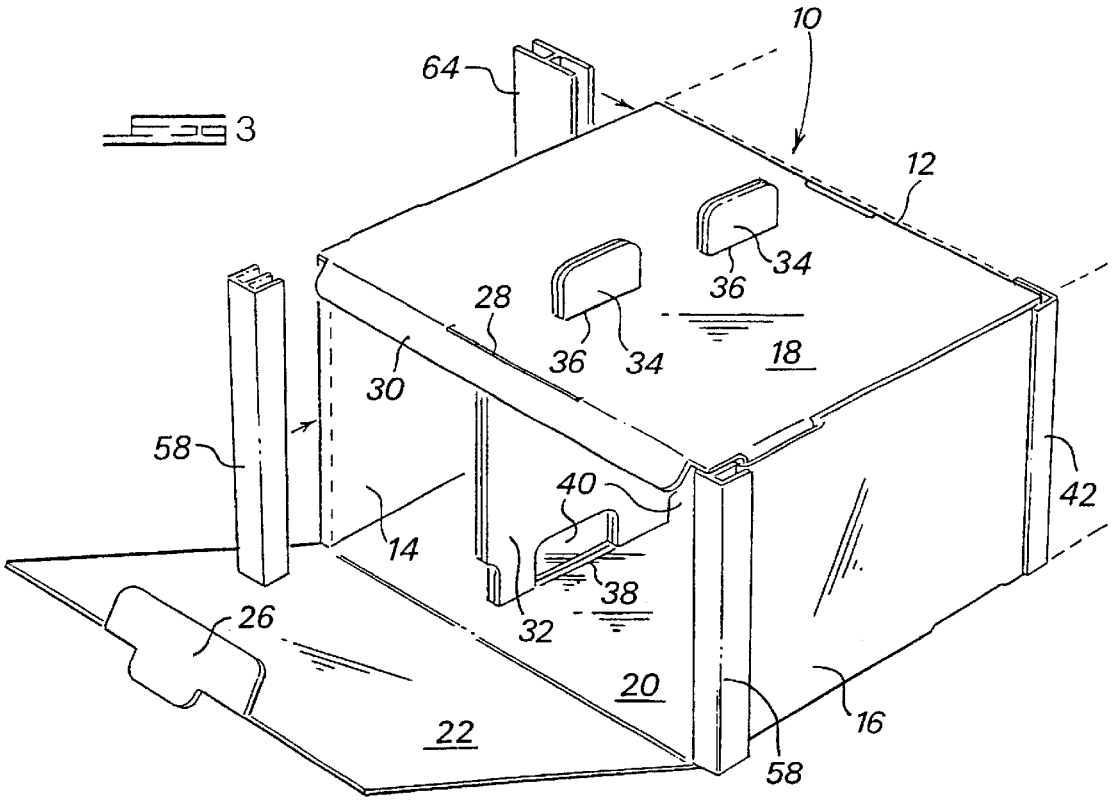
FIG. 3 shows a perspective view of the archive container fitted with the profiles of FIGS. 2A to 2C.

Referring first to FIG. 1, an archive container 10 is folded from a unitary blank of corrugated cardboard, and comprises a rear wall 12, a pair of side walls 14 and 16, each having a double wall thickness, a top wall 18 and a bottom wall 20. A front closure flap 22 is hinged to the bottom wall along an integral fold line 24. The closure flap 22 is formed with a tag 26 at its free end which locates within a complemental slot 28 formed in an overhanging lip 30 extending from the top wall 18.

The archive container is also formed with an intermediate double-walled partition 32 having a pair of aligning tongues 34 which pass through slots 36 in the top wall 18. The tongues 34 are arranged to pass through complemental slots 38 formed in the base of an identical superjacent container. To this end, the intermediate partition 32 is formed with a pair of complemental cut-outs 40 into which the tongues 34 of a subjacent container locate so that the containers can be aligned directly on top of one another in a stack.

In FIG. 1, a pair of reinforcing bars 42 are shown in broken outline fitted to the vertical side edges 44 of the side walls 14 and 16. A similar reinforcing bar 42 is similarly shown in broken outline fitted to an exposed side edge 48 of the rear wall 12. The rear wall effectively has a double wall thickness, as is clear from FIG. 8, in that it includes a flap portion 16A folded inwardly from the side wall 16.

Referring now to FIGS. 2A to 2C, the various different types of reinforcing bars are shown. The reinforcing bar 42 shown in FIG. 2A has a simple U-shaped profile, and is extruded from aluminium. The bar 42 comprises a pair of spaced apart legs 50 and 52. The legs are spaced apart by a distance which corresponds to a double wall thickness of cardboard, as is clear from FIG. 9. The opposed inner surfaces of the legs 50 and 52 are provided with wall-gripping ribs 54 extending in the longitudinal direction of the bar. The ribs 54 have a sawtooth profile, and are arranged so that the surface of each rib directed towards the opening 56 of the bar defines a shallow or sharp angle $\alpha$ relative to the major inner surface 57 of the legs of the profile. The angle $\alpha$ may vary from 20° to 40°, and is preferably 30°, allowing for the easy introduction of the profile over the side edges of the walls in a snug push fit, whilst at the same time reducing the ease of retraction of the reinforcing bar once it fully embraces the side wall edge.

Figure 4:
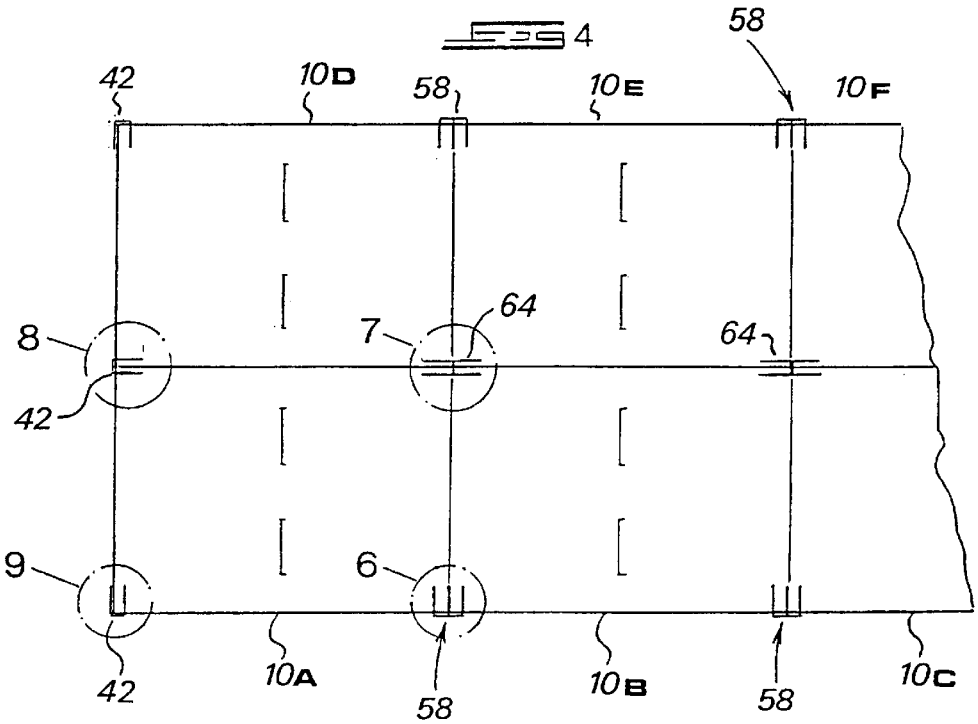
FIG. 4 shows a partly schematic top plan view of an array of archive containers joined together by the profiles of FIGS. 2A to 2C.
Figure 5:
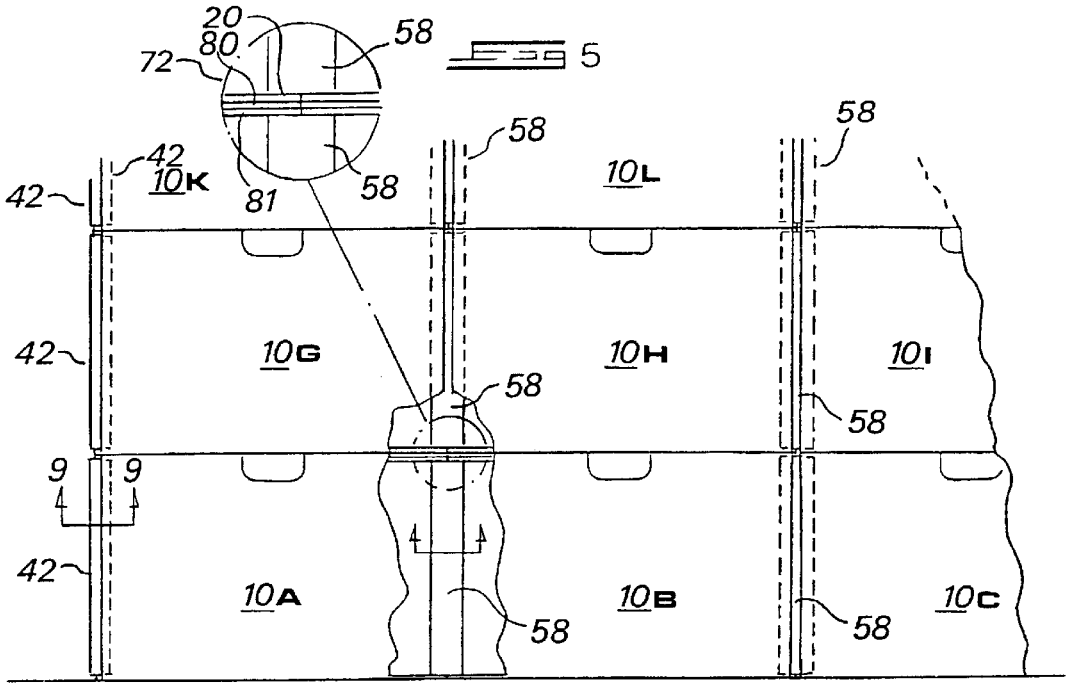
FIG. 5 shows a side view of a stack of joined together archive containers.
Figure 6:
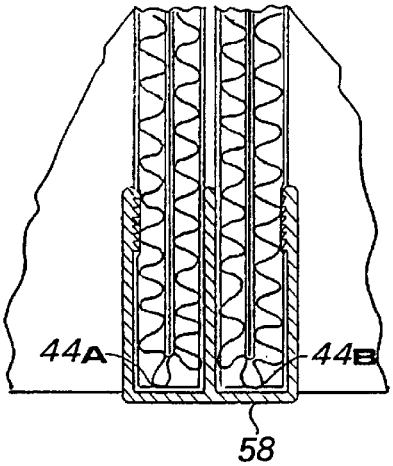
FIGS. 6 to 9 show sectional details of the connections indicated at 6 to 9 in FIG. 4, and along the lines 6—6 and 9—9 in FIG. 5, illustrating the various types of connections that can be made using the profiles of FIGS. 2A to 2C.

FIG. 2B shows a second embodiment of a reinforcing bar 58 comprising a pair of U-shaped profiles 60 and 62 arranged in a side-by-side W configuration for allowing side walls of adjacent containers 10A, 10B and 10C of FIGS. 4 and 5 to be joined together, as well as adjacent containers 10D, 10E and 10F. It has been found that it is not necessary to provide a central wall 59 of the bar with ribs, and that sufficient grip is achieved by providing such ribs 54 on the inner surfaces of the outer legs 50A and 52A. FIG. 6 provides a more detailed view of how adjacent double-walled side wall edges 44A and 44B are effectively joined using the reinforcing bar 58.

Figure 7:
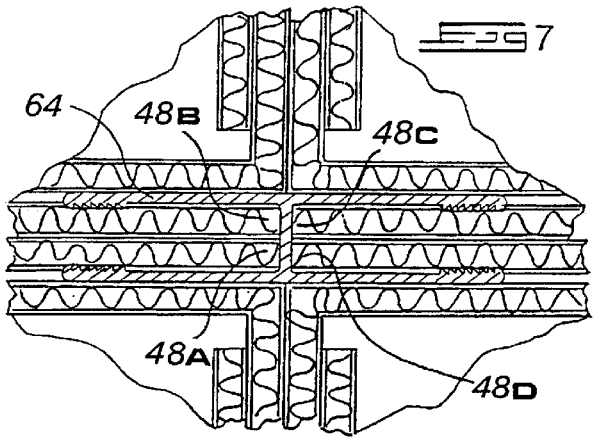

In FIG. 2C, a third embodiment of a reinforcing bar 64 is shown. The reinforcing bar 64 is formed with a pair of U-shaped profiles 66 and 68 which are arranged in a back-to-back H-configuration. The reinforcing bar 64 can be used to connect together four containers 10A, 10B, 10D and 10E at their rear wall edges, as is shown in FIGS. 4 and 7. In FIG. 7, it can clearly be seen how each of the rear wall edges 48A, 48B, 48C and 48D each have a single wall thickness, with the result that the four rear walls of four separate containers can be joined together using the single reinforcing bar 64 in the manner illustrated.

Figure 8:
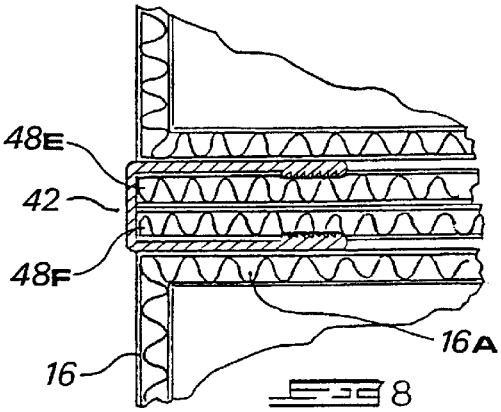
Figure 9:
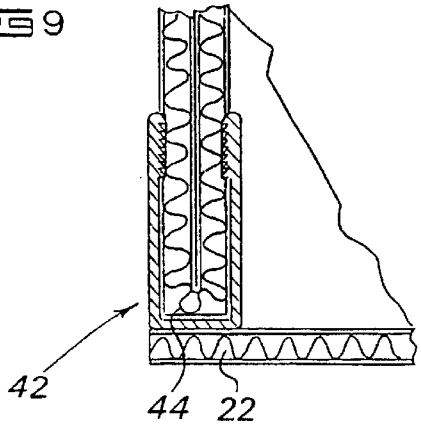

FIGS. 4 and 6 to 9 show clearly how a single layer of containers can effectively be joined together using the various types of reinforcing bars of FIGS. 2A to 2C, with the reinforcing bars 58 and 64 being used for intermediate connections, and the reinforcing bars 42 being used in the case of corner connections of the type illustrated in FIG. 9, as well as back-to-back end connections of the type illustrated in FIG. 8 for joining two single wall thickness rear wall edges 48E and 48F. The reinforcing bars 58 are used to join adjacent containers together in a side-by-side configuration, as is shown in FIG. 6 and the H-shaped reinforcing bars 64 connect the containers both in a back-to-back and side-by-side configuration, as is clear from FIG. 7.

Referring now to FIG. 5, containers 10A, 10G and 10K are shown stacked on top of one another, as are containers 10B, 10H and 10L. It can be seen how the provision of the complementary aligning tongues 36 and slots or grooves 38 allow for accurate alignment of the containers when stacked on top of one another such that the reinforcing bars 58 and 42 in the aligned stack define rigid co-linear reinforcing arrays, which effectively allows the overall height of the stack to be increased. The detail at 72 shows how the inwardly folded top wall 80 and side wall flange 81 of an underlying or subjacent container and the inwardly folded bottom wall 20 of an overlying or superjacent container are sandwiched between the reinforcing bars 58. These sandwiched walls provide a slight cushioning effect which contributes to the overall stability of the stacked structure It has been found that archive containers of the invention can now be stacked up to twenty high or more, whereas in the past the number of non-reinforced prior art containers that could be stacked on top of one another was limited to four to five high. This means that, in the case of a 250 mm high container, a stack of up to 5 m or more can be achieved, thereby utilizing the full height of most archive facilities. The load bearing capacity of a single reinforced container into which loaded archive boxes had been fitted was found to be around 1 ton.

In addition to increased load bearing capacity, the overall stability of the stacked structure is considerably increased by the ability of the reinforcing bars to serve as interconnectors for joining adjacent containers. The reinforcing bars can also be quickly and easily retrofitted to an existing stack, where necessary, prior to increasing the height of the stack.

What is claimed is:

1. A stackable archive container folded from a cardboard blank of a predetermined thickness and for being stacked next to and joined to vertical side edges of adjacent containers, the archive container comprising:

a pair of side walls, a top wall, a bottom wall and a rear wall, wherein rigid reinforcing bars are fitted to vertical side edges of the side walls and/or the rear wall at comers of the archive container, with the reinforcing bars extending the length of the side edges of the archive container and each of the bars having a least one or more U-shaped profiles for snugly embracing the side edges in a push fit, and the one or more U-shaped profiles of the reinforcing bars are configured to reinforce and to join together the vertical side edges of the adjacent containers.

2. A stackable archive container according to claim 1, wherein for each of the one or more U-shaped profiles, at least one of opposed inner surfaces of legs of the U-shaped profile are formed with wall-gripping ribs extending in the longitudinal direction of the bar for penetrating into outer surfaces of the cardboard to enhance a connection between the rib and the cardboard.

3. A stackable archive container according to claim 2, wherein the ribs have a sawtooth profile arranged so that a surface of each rib directed towards an opening of the U-shaped profile defines a shallow angle of 20° to 40° relative to the leg from which the ribs extend.

4. A stackable archive container according to claim 1, wherein the reinforcing bars include reinforcing bars having a single U-shaped profile sized to accommodate a double wall thickness of cardboard in a push fit.

5. A stackable archive container according to claim 4, wherein one of the side walls is the double wall thickness of cardboard, and the other of the side walls is a double wall thickness of cardboard.

6. A stackable archive container according to claim 4, wherein the archive container is a first container, the adjacent containers includes a second container, and the first container is in combination with the second container, and wherein the double wall thickness of cardboard includes one of the side walls of the first container and a side wall of the second container, and the U-shaped profile embraces the double wall thickness of cardboard so that the first container and the second container are joined side-by-side.

7. A stackable archive container according to claim 4, wherein the archive container is a first container, the adjacent containers includes a second container, and the first container is in combination with the second container, and wherein the double wall thickness of cardboard includes one of the rear walls of the first container and a rear wall of the second container, and the U-shaped profile embraces the double wall thickness of cardboard so that the first container and the second containers are joined back-to-back.

8. A stackable archive container according to claim 1, wherein the reinforcing bars include reinforcing bars having a double U-shaped profile in a side-by-side W-configuration, for allowing side walls of the adjacent containers to be connected, while simultaneously being reinforced.

9. A stackable archive container according to claim 8, with the side walls of the archive container having a double wall thickness, and each of the U-shaped profiles are sized to accommodate the side edges of the side walls of the archive container in a push fit.

10. A stackable archive container according to claim 1, wherein the archive container is a first container, the first container is in combination with three of the adjacent containers, and the reinforcing bars include bars having a double U-shaped profile in a back-to-back H-configuration for allowing the first container to be connected to the three of the adjacent containers at the side edges of their rear walls, while simultaneously being reinforced for stacking.

11. A combination according to claim 10, wherein each of the rear walls have a single wall thickness, and each of the double U-shaped profiles are arranged to accommodate the rear adjacent walls of a pair of containers, which are selected from a group consisting of the first container and the three of the adjacent containers, in a back-to-back configuration.

12. A stackable archive container according to claim 1 wherein the archive container is one of a plurality of archive containers that are alike and in combination with one another, each of the archive containers is formed with a front closure flap hinged to the top or bottom walls and with complementary aligning formations, and the aligning formations are for allowing the archive containers to be aligned when stacked on top of one another such that the reinforcing bars in the aligned stack define rigid co-linear reinforcing arrays allowing an overall height of the stack to be increased.

13. A stackable archive container according to claim 1 wherein the reinforcing bars are extruded from aluminum.

14. A method of assembling and arranging multiple stackable archive containers, comprising the steps of: forming each of the containers by folding the container from a cardboard blank to provide a pair of side walls, a top wall, a bottom and a rear wall; fitting rigid reinforcing bars to some of vertical side edges of the side walls and/or the rear walls at comers of the containers, the reinforcing bars extending the length of the side edges and each of the bars having at least one U-shaped profile for snugly embracing the side edges in a push fit; and joining together the containers along other of their vertical side edges using the one or more U-shaped profiles of the reinforcing bars to embrace the other of the vertical side edges in a push fit, to form a layer of the containers that are adjacent and connected.

15. A method according to claim 11, further comprising repeating the steps of claim 14 to create additional layers of the container that are stacked on top of one another in an aligned configuration such that the reinforcing bars in the aligned stack define rigid co-linear reinforcing arrays allowing an overall height of the stack to be increased.

* * * * *

UNITED STATES PATENT AND TRADEMARK OFFICE

CERTIFICATE OF CORRECTION

PATENT NO. : 6,431,436 B1
DATED : August 13, 2002
INVENTOR(S) : Evers

It is certified that error appears in the above-identified patent and that said Letters Patent is hereby corrected as shown below:

Title page,
Item [86], PCT No.: "PCT/NL97/00087" should read -- PCT/NL99/00087 --.

Column 2,
Line 2, "comers" should read -- corners --.

Column 4,
Last line, after "structure" insert a period (.).

Column 5,
Line 25, "comers" should read -- corners --.

Column 6,
Line 49, "comers" should read -- corners --;
Line 58, "claim 11" should read -- claim 14 --.

Signed and Sealed this

Twenty-sixth Day of November, 2002

*Attest:*

*Attesting Officer*

JAMES E. ROGAN
*Director of the United States Patent and Trademark Office*